United States Patent [19]

Theobald

[11] 3,973,328

[45] Aug. 10, 1976

[54] PAPER MATERIAL DRYER

[75] Inventor: Donald David Theobald, Ilford, England

[73] Assignee: Ilford Limited, England

[22] Filed: Apr. 22, 1974

[21] Appl. No.: 463,171

Related U.S. Application Data

[63] Continuation-in-part of Ser. No. 363,871, May 25, 1973, abandoned.

[30] Foreign Application Priority Data

| | | |
|---|---|---|
| May 26, 1972 | United Kingdom | 24946/72 |
| May 24, 1973 | Germany | 2326573 |
| May 24, 1973 | France | 73.19000 |
| May 24, 1973 | Italy | 50193/73 |
| May 21, 1973 | Switzerland | 7191/73 |
| Mar. 15, 1974 | United Kingdom | 11592/74 |

[52] U.S. Cl. ..... 34/4; 34/23; 34/41; 427/55; 427/374; 427/385

[51] Int. Cl.[2] ..... F26B 3/30

[58] Field of Search ..... 34/4, 18, 20, 23, 41, 34/151, 152, 155, 162, 95; 219/216, 354, 388; 117/34, 119.2, 119.6; 427/55, 385, 374, 391

[56] References Cited

UNITED STATES PATENTS

| | | | |
|---|---|---|---|
| 2,442,407 | 6/1948 | Gibbons et al. | 219/34 |
| 2,534,205 | 12/1950 | Newhall et al. | 34/95 |
| 2,559,713 | 7/1951 | Dunski et al. | 34/18 |
| 3,287,816 | 11/1966 | Mignone | 34/18 |
| 3,639,207 | 2/1972 | Genz et al. | 34/18 |
| 3,811,913 | 5/1974 | Kasugai et al. | 117/34 |

*Primary Examiner*—John J. Camby
*Assistant Examiner*—Larry I. Schwartz
*Attorney, Agent, or Firm*—Wenderoth, Lind & Ponack

[57] ABSTRACT

A method and apparatus for drying polyethylene laminated base photographic paper in sheet form. The exposed and processed sheet of photographic paper bearing a photographic image on one side thereof is caused to travel through an enclosed drying chamber. Radiant heat is directed from sources onto both sides of the sheet of photographic paper as it is caused to travel through the drying chamber. The radiant heat is applied for sufficient time to cause any shallow indentation lines on the image side of the photographic paper to disappear. Simultaneously a stream of cool air is caused to flow over the image side of the photographic paper. Both sources are provided with means for directing the radiant heat on to each side respectively of the support. There are further provided means for causing a stream of cool air to flow over the support and at least one pair of nip rollers for driving the sheets of photographic paper into the apparatus and a pair of nip rollers for driving the sheets of photographic paper out of the apparatus and means for causing streams of cool air to flow over and through the pairs of nip rollers which drive the sheets of photographic paper into and out of the apparatus.

7 Claims, 2 Drawing Figures

PAPER MATERIAL DRYER

This invention relates to a method and an apparatus for drying a polyethylene laminated base photographic paper so as to produce a high gloss thereon and is a continuation-in-part of our application Ser. No. 363,871 which was filed on May 25, 1973 and was entitiled "Paper material dryer" and is now abandoned.

BACKGROUND OF THE INVENTION

One form of photographic paper in sheet form which recently has come into common use is paper base covered on each side with a thin layer of polyethylene, there being coated on one polyethylene layer a layer of photographic emulsion.

Photographic paper material coated on polyethylene laminated base was introduced to cut down the processing time of the material as less processing solution would be absorbed and thus the washing and drying times for the material could be reduced. However photographic material of this type can not be glazed on a hot bed glazer to produce the highest gloss because the absorbed moisture can not escape through the back of the paper. Polyethylene laminated photographic material inherently has a higher gloss than normal photographic paper but when dried in the type of drier used for normal photographic paper an imperfect gloss is obtained.

SUMMARY OF THE INVENTION

A method of drying polyethylene laminated base photographic material has now been discovered by means of which a high gloss on the image side of processed and dried material may be obtained.

According to the present invention there is provided a method of drying polyethylene laminated base photographic paper bearing a silver or dye image in a gelatin layer on one side of the material so as to produce a high degree of gloss on the image side of the material, which method comprises passing the material through an enclosed drying chamber and directing radiant heat on to both sides of the sheet of photographic material and simultaneously causing a stream of cool air to flow over the image side of the material, the radiant heat being applied for sufficient time to cause any shallow indentation lines on the image side of the material to disappear.

Preferably in the method of the present invention the temperature of the cool air which is caused to flow over the image side of the photographic paper is between 20°–40°C.

It is an important feature of the method of the present invention that the stream of cool air flows over the image side of the photographic paper as radiant heat is being directed on to this side.

In order to obtain the high gloss it is necessary that radiant heat is applied to the material for sufficient time to cause any shallow indentation lines present on the image side of the material to disappear. If the material after drying by the method of the present invention is rewetted and then dried using cold air the indentation marks reappear. But if the material is dried using radiant heat and cool air but insufficient radiant heat to cause indentation lines to disappear a markedly inferior degree of gloss on the image surface of the material is obtained.

However if ordinary paper-based photographic material is dried using radiant heat and cool air using the same apparatus indentation lines present on the material will not disappear and the material will not exhibit a high degree of gloss. This shows the method of the present invention can only be applied to polyethylene laminated paper. The high gloss obtained and the disappearance of indentation lines are certainly connected in some way with behaviour of the surface of the gelatin under the drying conditions used and also are dependent on the gelatin layer being present on a polyethylene laminated base. However no clear explanation which could fit all the facts has yet been discovered. Thus the method of the present invention is applicable only to polyethylene laminated base photographic material bearing on one side a silver or dye image in a gelatin layer.

The application of sufficient radiant heat to cause any indentation lines on the polyethylene laminated base photographic material to disappear is thus an essential feature of the present invention and if insufficient heat is applied the degree of gloss on the image surface of the material after drying is inadequate. If too much heat is applied there is a danger, of course, that the polyethylene coating will melt and become blistered and thus the material will be ruined.

The numbers of radiant heaters employed in the apparatus and the length of time the material is in the enclosed space are factors to be considered in order to ensure that sufficient radiant heat is applied to the material during the drying.

Another feature of the method of the present invention is that cool air should flow over pairs of nip rollers which serve to drive the sheets of photographic material into and out of the apparatus, since heated rollers provide a potential uncontrolled drying effect. Preferably the stream of cool air which flows over the output pair of nip rollers also impinges on the photographic material as it emerges from the apparatus. This helps to prevent the paper from curling.

According to another aspect of the present invention there is provided an apparatus for drying cut sheets of polyethylene laminated base photographic paper by the method as just set forth which comprises an enclosed drying chamber having an open support therein for supporting the sheets of photographic paper in their passage through the drying chamber, a source of radiant heat located on the side of the support remote from the side which supports the sheets of photographic paper, together with means for directing the radiant heat on to this side of the open support, a source of radiant heat on the side of the support which supports the sheets of photographic paper and means for directing the radiant heat on to this side of the support, and means for causing a stream of cool air to flow over the support, and at least one pair of nip rollers for driving the sheets of photographic paper into the apparatus and a pair of nip rollers for driving the sheets of photographic paper out of the apparatus, and means for causing streams of cool air to flow over and through the pairs of nip rollers which drive the sheets of photographic paper into and out of the apparatus.

By open support is meant a support through which radiant heat can be directed. Examples of open supports are wire mesh or thin metal strips or wires formed into a support.

Preferably the pair of nip rollers for driving the sheets of photographic paper out of the apparatus are covered with a foamed plastics material, for example foamed neoprene, because it has been found that foamed plastics material marks the photographic material less than harder rollers.

The preferred source of radiant heat is a radiant heater of the bar type. The preferred means for directing the radiant heat on to the material in the enclosed chamber is a metal reflector. Preferably there is at least one bar radiant heater and reflector located on the side of the open support which supports the sheets of photographic paper to direct radiant heat onto the image face of the paper while the paper is on the support.

There is located in the apparatus on the side of the support which does not support the sheets of photograahic paper at least one bar radiant heater and a reflector to direct the radiant heat on to the reverse side, i.e. non-image side, of the photographic paper through the open support.

The cool air is preferably provided by a turbo-fan. Since it is required that the sheets of photographic paper are traversed through the apparatus with their image sides remote from the support, the streams of cool air are passed over the image surface of the material as they are being heated by the radiant heat. Preferably the temperature of the cool air as it passes over the image side of the photographic paper is between 20°–40°C.

Preferably several streams of cool air are provided so that the image surfaces of the sheets of photographic paper are continuously in contact with a fresh supply of cool air which is at a temperature of between 20°–40°C.

Preferably the pair or pairs of nip rollers which serve to drive the sheets of photographic paper into the apparatus comprise a pair of squeegee rollers for example a pair of rubber rollers. The squeegee rollers remove excess water from the surface of the sheets of photographic paper when they come straight from a wash bath. Preferably there are two such pairs of squeegee rollers.

It is to be understood that the minimum size of the sheets of photographic paper which can be dried in the apparatus depends on the distance between the nip rollers which drive the sheets into the apparatus and the nip rollers which drive the sheets out of the apparatus. One or other or both of these pairs of nip rollers must be acting on a sheet at any one time while it is in the apparatus.

BRIEF DESCRIPTION OF THE DRAWINGS

The accompanying drawings will serve to illustrate a drying apparatus according to the invention.

DETAILED DESCRIPTION OF THE INVENTION

Figure 1:
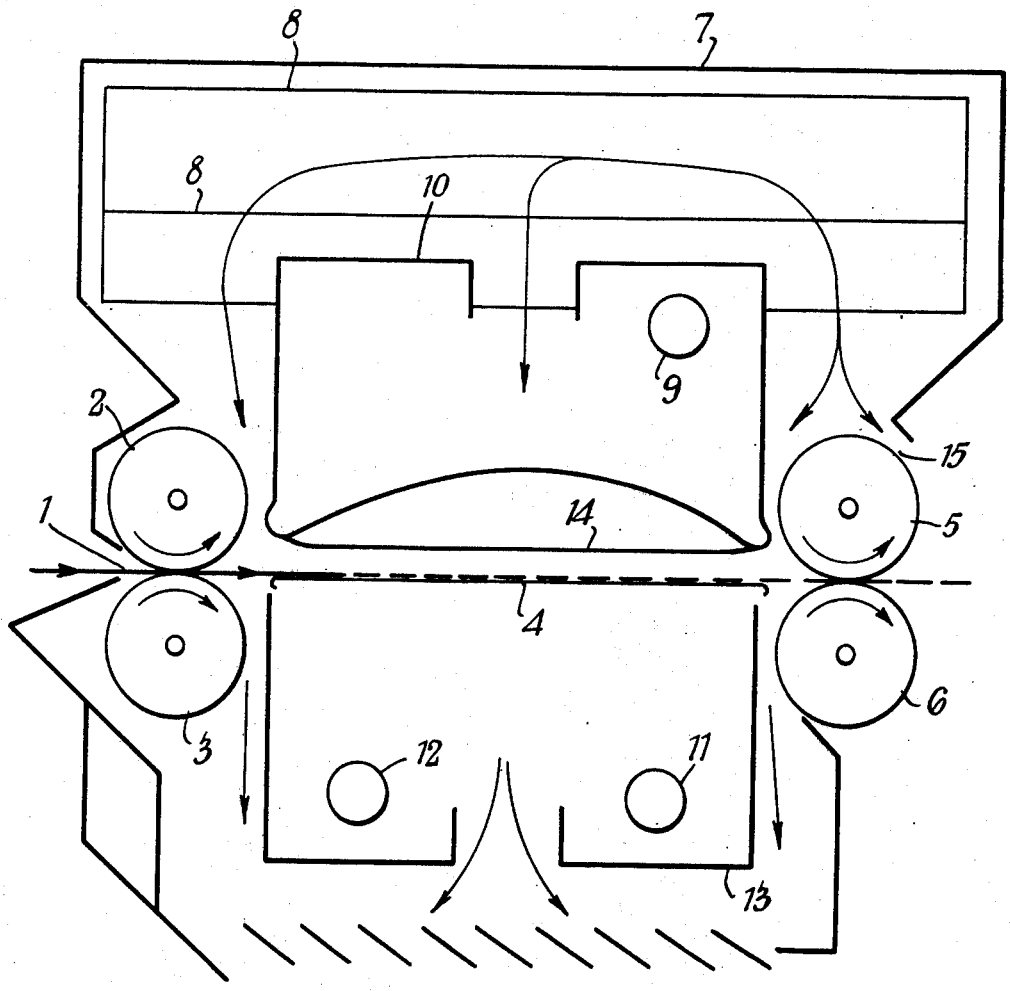
FIG. 1 is a cross sectional side elevation of the apparatus.

In FIG. 1 a cut sheet of photographic paper 1 is shown entering the apparatus. It is driven into the apparatus by means of a pair of rubber-covered nip rollers 2 and 3, on to the open support 4 which comprises a network of metal wires. The open support 4 extends across the length of the apparatus to a pair of foamed neoprene covered rollers 5 and 6. (The direction in which all the rollers rotate is indicated by the arrows thereon). The apparatus is enclosed in a cover 7 and inside the cover 7 are air baffles 8. There is present above the open support 4 a bar radiant heater 9. Radiant heat from this heater is directed on to the surface of the support 4 by a reflector 10. Located below the support 4 are two bar radiant heaters 11 and 12. Heat from these radiant heaters is directed on to the underside of the support 4 by a reflector 13. A guide 14 prevents the sheets of photographic paper from curling up and touching the radiant heater bar 9.

Figure 2:
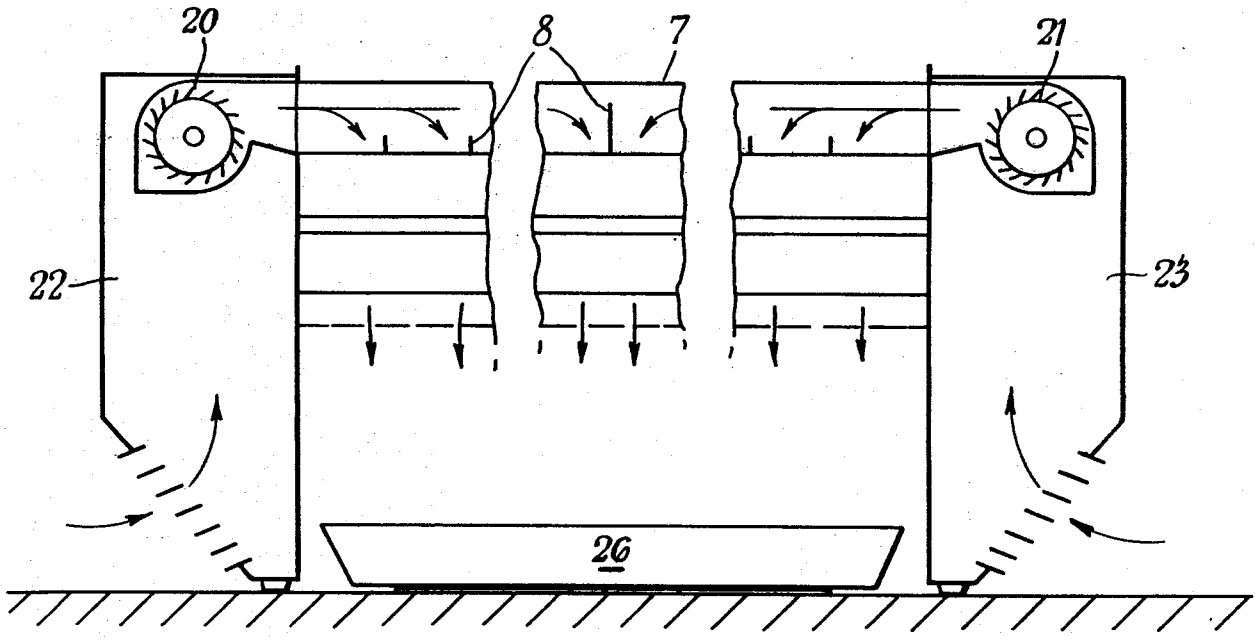
FIG. 2 is a cross sectional front elevation of the apparatus shown in FIG. 1.

In FIG. 2, two turbo-fans 20 and 21 are in end boxes 22 and 23 which are attached to the cover 7 of the dryer. The direction of the air flow produced by these turbo fans 20 and 21 is indicated by the arrows in FIGS. 1 and 2. Cool air first strikes the photographic paper as it emerges from the driven nip rollers 2 and 3 and flows over its surface. Further streams of air are directed on to the paper as it is traversed through the machine. These are through the centre of the top reflector 10 and through a gap between the reflector 10 and the roller 5.

In operation the heaters 9, 11 and 12 are turned on and air from the turbo fans is directed through the baffles. A cut sheet of photographic paper is removed from the washing dish 26 which is located under the apparatus and is then fed into the apparatus with the image or emulsion surface upwards through the nip of the rollers 2 and 3. These rollers remove excess moisture from the paper and drive the paper on to the support 4 and it is then acted on by a stream of cool air from the turbo fans 20 and 21. Then as it comes under the reflector 10 and over the reflector 13 radiant heat is directed on to both the image surface and the underneath surface of the sheet of paper from the radiant heaters. The sheet of paper is traversed by the nip rollers 2 and 3 through the apparatus over the support 4 until it reaches the nip of the rollers 5 and 6 which drive it out of the apparatus. Thus the streams of cool air pass over the surface only of the photographic paper during the time radiant heat is reflected on to it, and a stream of cool air cools the rollers 2, 3, 5 and 6. As the sheet of paper emerges from the rollers 5 and 6 a stream of cool air impinges on it through the gap 15 between the casing and the nip roller 5.

In one test a sheet of exposed and process photographic paper of the polyethylene laminated base bearing a silver image in a gelatin layer type was dried in an apparatus as shown in FIGS. 1 and 2. The pairs of nip rollers 2 and 3 and 5 and 6 were 4.5 inches apart. The length of time the material was in the drying apparatus was 9 seconds. Three radiant heaters each of 600 watts were employed. The material when received out of the drying apparatus was substantially flat and had very little tendency to curl. The print exhibited a high gloss as shown in the Table below and the dark areas of the image exhibited no milkiness.

The gloss on the polyethylene laminated base material dried in this test was compared with the gloss obtained by drying exposed and processed paper base photographic material on the same apparatus and with polyethylene laminated base dried using insufficient radiant heat. Also the gloss on photographic material which had been hot glazed was determined. A shallow surface indentation was made on each sample of photographic material before it was dried.

The degree of glossiness shown in the Table below was measured using an arbitrary scale in which a specular surface is considered to have a glossiness of 10.

TABLE

| Material | Method of Drying | Glossiness | Surface Indentation |
|---|---|---|---|
| Polyethylene laminated base | Cold air dried | 3 | Still Present |
| Polyethylene laminated base | Using cool air but insufficient radiant heat | 6 | Still Present |
| Polyethylene laminated base | Using method of the invention | 8 | Disappeared |
| Polyethylene laminated base | Image side on hot glazer | 2 | Still Present |
| Paper base | Using same conditions as method of the invention | 3 | Still Present |
| Paper base | Image side on hot glazer | 8 | Disappeared |

This shows that the method of the present invention can be used only with polyethylene laminated base photographic material which, of course, can not be hot glazed to produce a high gloss finish as the moisture can not escape from the material through the back as is the case with paper material. Further this test shows the importance of applying sufficient radiant heat. The criterion used to show if sufficient radiant heat has been applied is if indentation marks initially present on the material have disappeared after drying.

What we claim is:

1. A method of drying polyethylene laminated base photographic paper bearing a silver or dye image in a gelatin layer on one side of the paper, so as to produce a high degree of gloss on the image side of the paper, said method comprising:

providing polyethylene laminated base photograhic paper having on one side thereof a silver or dye image in a gelatin layer;

passing said photographic paper through an enclosed drying chamber;

directing radiant heat on both sides of said photographic paper in an amount sufficient to cause any shallow indentation lines on said image side of said photographic paper to disappear; and simultaneously causing a stream of cool air to flow over the image side of said photographic paper, thereby drying said photographic paper and producing a photographically satisfactory high degree of gloss on said image side.

2. A method according to claim 1, wherein the temperature of said stream of cool air is maintained between 20° and 40°C.

3. A method according to claim 1, wherein said step of passing comprises driving said photographic paper into and out of said drying chamber by means of respective pairs of nip rollers; and further comprising directing said stream of cool air to flow over said pairs of nip rollers; and further directing said stream of cool air to impinge on said photographic paper as it emerges from said drying chamber.

4. A method of drying polyethylene laminated base photographic sheet material bearing a silver or dye image in a gelatin layer on one side of the material, so as to produce a high degree of gloss on the image side of the material, said method comprising:

providing sheets of polyethylene laminated base photographic material having on one side thereof a silver or dye image in a gelatin layer;

providing at least one indentation on line on the image surface of at least one said sheet of photographic material;

drying said at least one said sheet of photographic material, said drying comprising passing said at least one sheet through an enclosed drying chamber, directing radiant heat onto both sides of said at least one sheet of photographic material, and simultaneously causing a stream of cool air to flow over the image side of said at least one sheet of photographic material;

continuing said drying until said at least one indentation line has disappeared;

determining the drying time required to cause said at least one indentation line to disappear; and then drying similar sheets of photographic material in the same way for at least the thus determined drying time.

5. A method of drying polyethylene laminated base photographic paper bearing a silver or dye image in a gelatin layer on one side of the paper, so as to produce a high degree of gloss on the image side of the paper, said method comprising:

providing polyethylene laminated base photographic paper having on one side thereof a silver or dye image in a gelatin layer;

passing said photographic paper through an enclosed drying chamber;

directing radiant heat onto both sides of said photographic paper for a time sufficient to cause any shallow indentation lines on said image side of said photographic paper to disappear; and simultaneously causing a stream of cool air to flow over the image side of said photographic paper, thereby drying said photographic paper and producing a photographically satisfactory high degree of gloss on said image side.

6. A method according to claim 5, wherein the temperature of said stream of cool air is maintained between 20° and 40°C.

7. A method according to claim 5, wherein said step of passing comprises driving said photographic paper into and out of said drying chamber by means of respective pairs of nip rollers; and further comprising directing said stream of cool air to flow over said pairs of nip rollers; and further directing said stream of cool air to impinge on said photographic paper as it emerges from said drying chamber.

* * * * *